US008403683B2

(12) United States Patent
Yao et al.

(10) Patent No.: US 8,403,683 B2
(45) Date of Patent: Mar. 26, 2013

(54) CARD EDGE CONNECTOR WITH IMPROVED COVER

(75) Inventors: Ze-Lin Yao, Kunshan (CN); Zhuang-Xing Li, Kunshan (CN); Xue-Wu Bu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 212 days.

(21) Appl. No.: 12/903,232

(22) Filed: Oct. 13, 2010

(65) Prior Publication Data

US 2011/0086552 A1 Apr. 14, 2011

(30) Foreign Application Priority Data

Oct. 13, 2009 (CN) ..... 2009 2 0312345

(51) Int. Cl.
*H01R 12/00* (2006.01)

(52) U.S. Cl. ..... 439/79

(58) Field of Classification Search ..... 439/79, 439/80

See application file for complete search history.

(56) References Cited

U.S. PATENT DOCUMENTS

| | | | | | |
|---|---|---|---|---|---|
| 2,935,725 | A * | 5/1960 | Fox | 439/633 |
| 5,167,531 | A * | 12/1992 | Broschard et al. | 439/541.5 |
| 5,688,130 | A * | 11/1997 | Huang | 439/79 |
| 5,863,222 | A * | 1/1999 | Kinsey et al. | 439/607.53 |
| 5,906,518 | A * | 5/1999 | Sun | 439/660 |
| 5,980,272 | A * | 11/1999 | McHugh et al. | 439/79 |
| 6,093,032 | A * | 7/2000 | McHugh et al. | 439/79 |
| 6,287,146 | B1 * | 9/2001 | Avery et al. | 439/607.4 |
| 6,626,700 | B2 * | 9/2003 | Lin | 439/541.5 |
| 6,666,714 | B1 * | 12/2003 | Li et al. | 439/521 |
| 7,473,133 | B1 * | 1/2009 | Zhang | 439/607.01 |
| 7,717,721 | B2 | 5/2010 | Wu et al. | |
| 2003/0008552 | A1 | 1/2003 | Lin | |
| 2003/0166348 | A1 | 9/2003 | Martin et al. | |

* cited by examiner

*Primary Examiner* — Neil Abrams

(74) *Attorney, Agent, or Firm* — Wei Te Chung; Ming Chieh Chang

(57) ABSTRACT

A card edge connector comprises an insulative housing defining a front mating face and a central slot recessed rearwardly from the mating face. A plurality of contacts each has a contact portion exposed into the central for mating with a complementary connector and a solder tail exposed to outside of the housing. A cover is assembled to a rear side of the housing. A spacer sandwiched between the housing and the cover along a front-to-rear direction. The spacer defines a plurality of through holes through which the solder tails of the contacts passing.

18 Claims, 6 Drawing Sheets

CARD EDGE CONNECTOR WITH IMPROVED COVER

BACKGROUND OF THE INVENTION

1. Field of the Invention

The present invention generally relates to a card edge connector, and particularly relates to a card edge connector having an improved cover for ensuring structural strength thereof.

2. Description of Related Art

Card edge connectors are employed widely in computers to receive a memory card, graphic card, network interface card et al. The card edge connector usually has an insulative housing with an elongated slot, a plurality of contacts retained in the housing and with contact portions exposed in the slot, an insulative cover retained on the housing, and a spacer retained on a bottom portion of the housing. The spacer has a plurality of positioning posts extending downwardly. The spacer has a plurality of positioning holes cooperating with the positioning posts respectively. Thus, the structural strength of the card edge is not enough for using.

Hence, it is desirable to have an improved card edge connector to overcome the above-mentioned disadvantages of the related art.

SUMMARY OF THE INVENTION

According to one aspect of the present invention, a card edge connector, comprises an insulative housing defining a front mating face and a central slot recessed rearwardly from the mating face; a plurality of contacts retained in the insulative housing and each having a contact portion exposed into the central slot for mating with a complementary connector and a solder tail exposed to outside of the housing; a cover assembled to a rear side of the housing, and a spacer sandwiched between the housing and the cover along a front-to-rear direction, the spacer defining a plurality of through holes through which the solder tails of the contacts passing.

According to another aspect of the present invention, a card edge connector, comprises an insulative housing including a body portion with an elongated central slot, two opposite side walls protruding rearwardly and downwardly from the body portion, and a receiving space formed thereamong; a plurality of contacts disposed in the housing with contact portions exposed into the central slot for mating with a complementary connector, solder tails exposed to outside of the body portion; an insulative cover wholly retained in the receiving space, and having a top wall and a rear wall bending downwardly from the top wall, both of the top wall and the rear wall enclosing the receiving space; and an insulative spacer located in the receiving space and defining a plurality of through holes through which said solder tails extend; wherein at least one of the cover and the spacer is fastened to the housing.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENT

Figure 1:
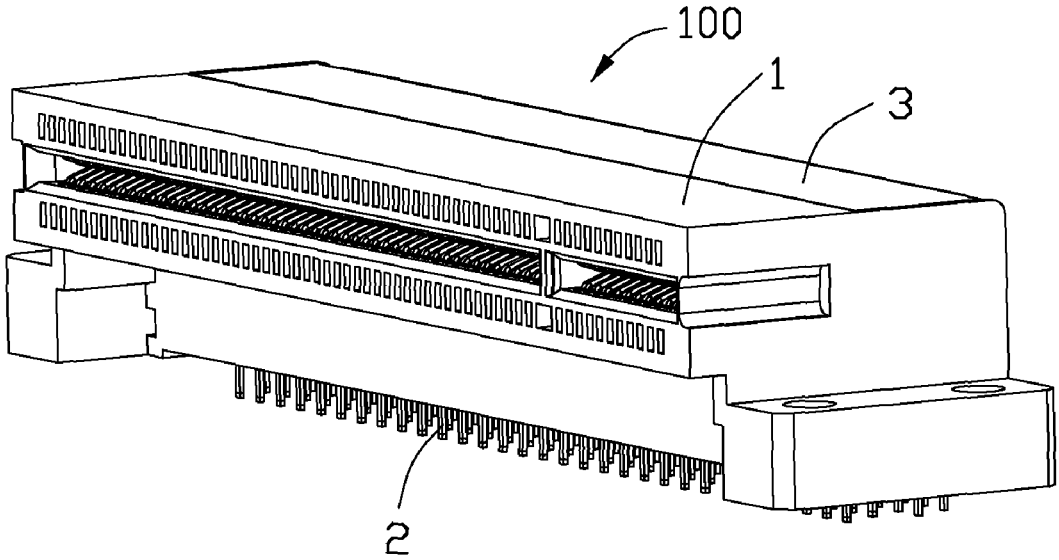
FIG. 1 is a perspective view of a card edge connector in accordance with a first embodiment of the present invention.
Figure 2:
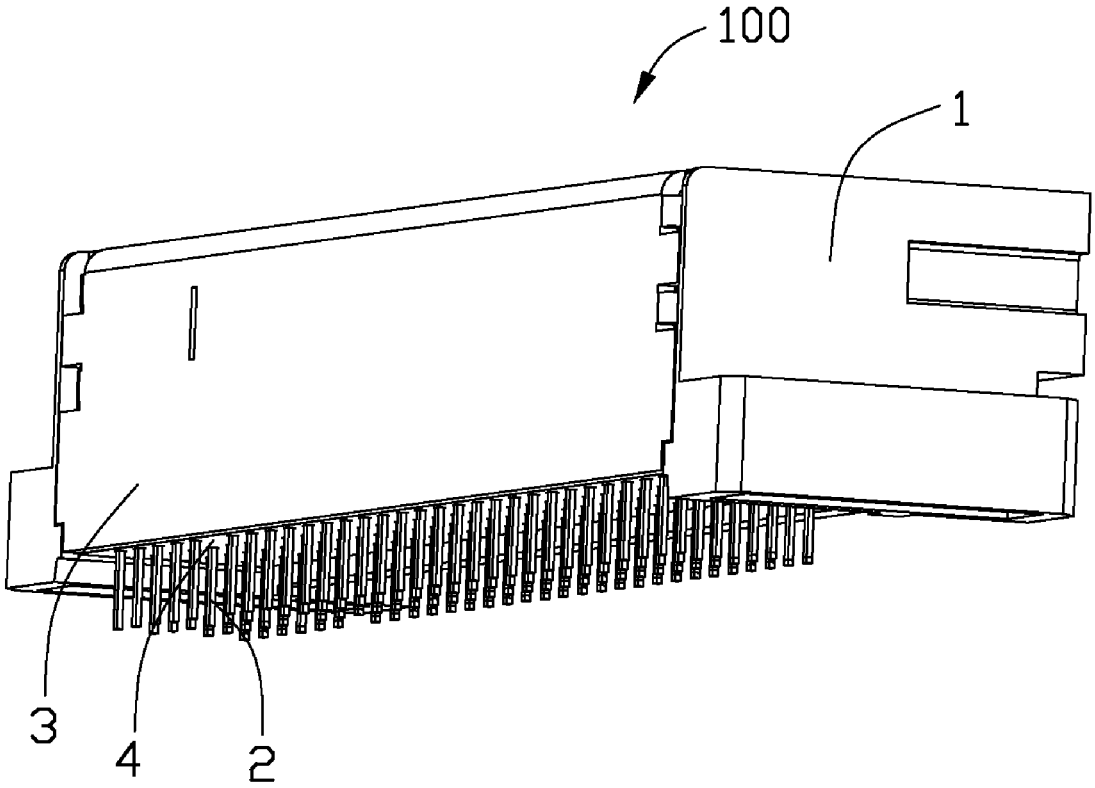
FIG. 2 is another perspective view of the card edge connector shown in the FIG. 1.
Figure 3:
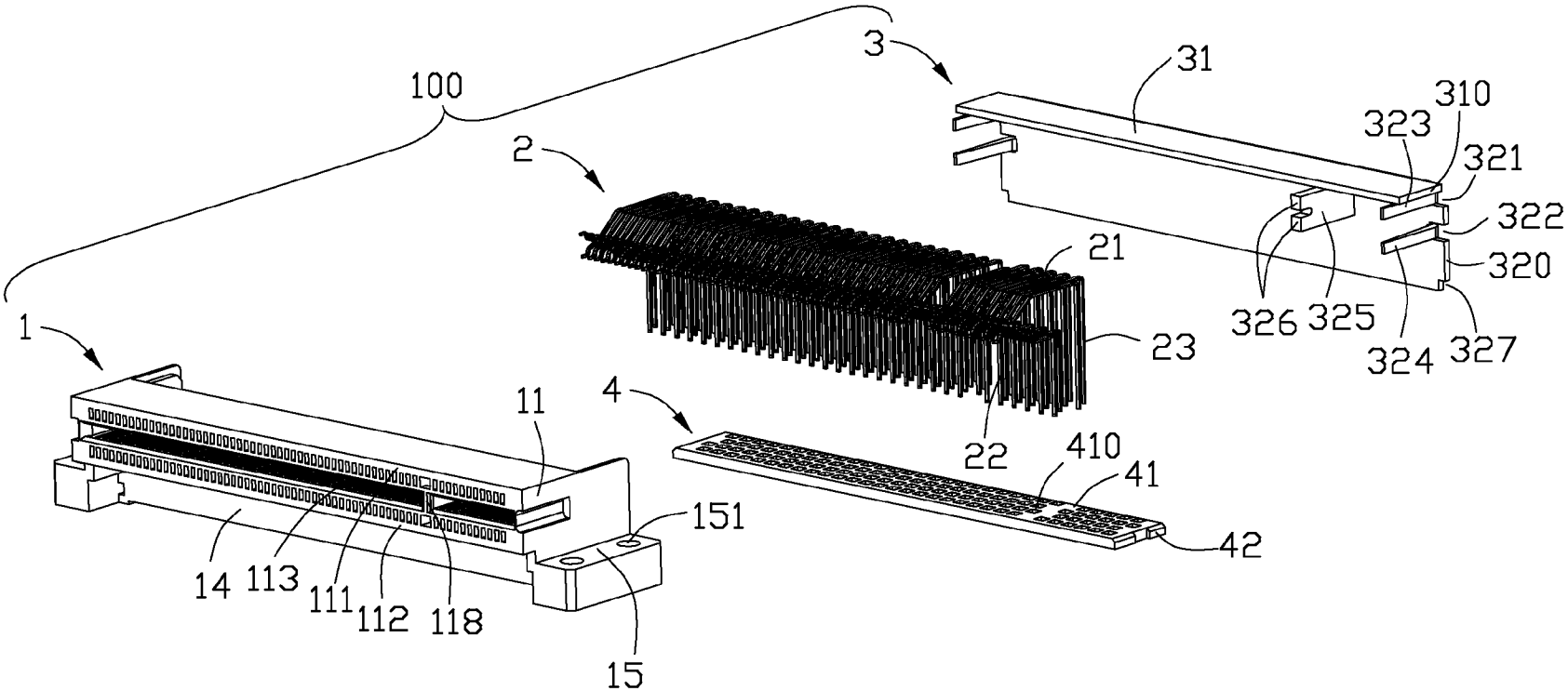
FIG. 3 is an exploded perspective view of the card edge connector shown in the FIG. 1.
Figure 4:
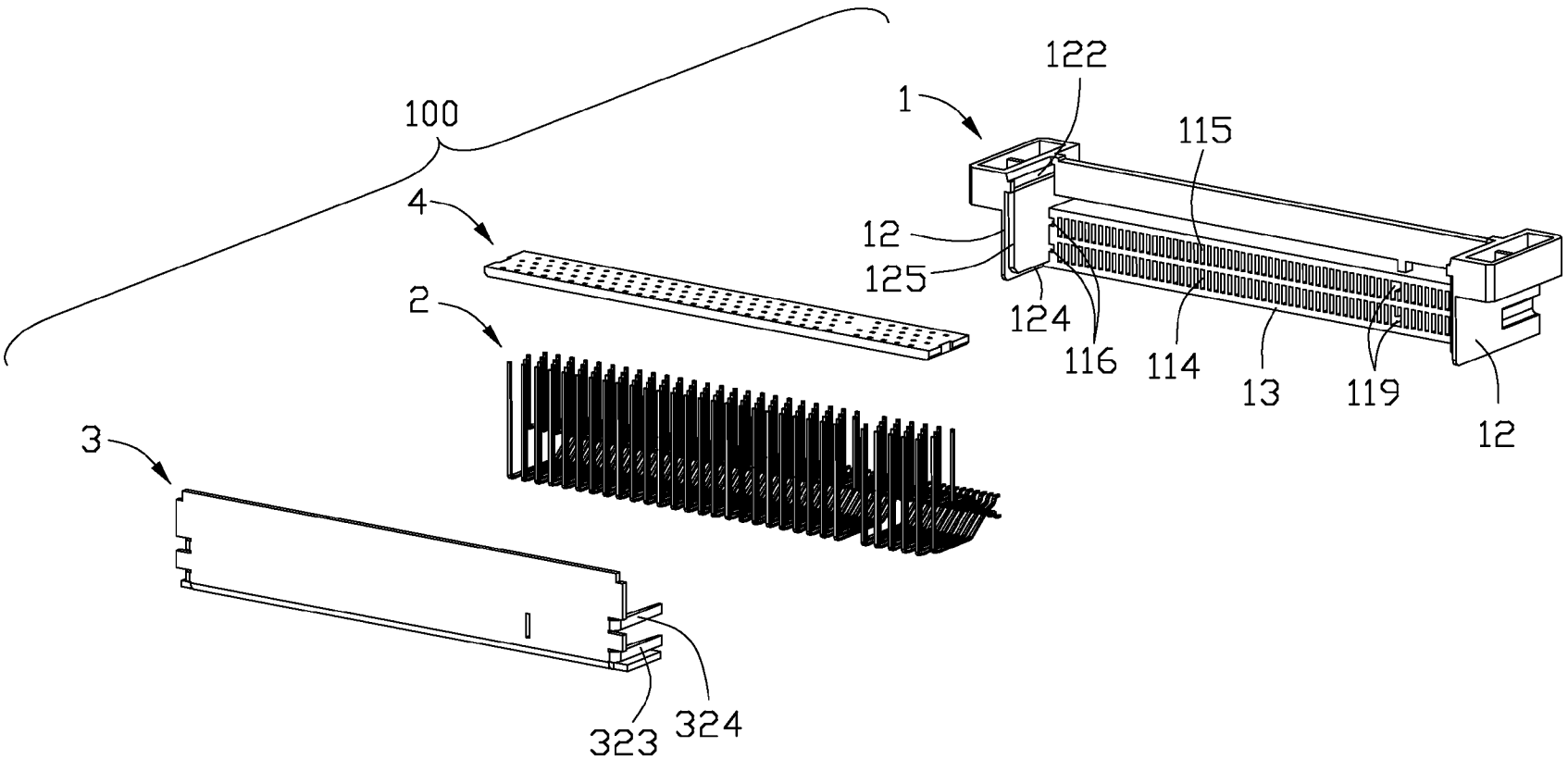
FIG. 4 is another exploded perspective view of the card edge connector shown in the FIG. 1.

Reference will now be made to the drawing figures to describe the present invention in detail.

With reference to FIGS. 1-4, a card edge connector 100 in accordance with a first embodiment of the present invention, which is adapted for being mounted on a mother board (not shown) and receiving a memory card (not shown). The card edge connector 100 is a right angle PCI (Peripheral Component Interconnect) connector and comprises an elongated housing 1, a plurality of conductive contacts 2 retained in the housing 1, an insulative cover 3 and a spacer 4 both attached to housing 1.

The housing 1 includes a front body portion 11, a pair of side walls 12 protruding rearwardly and downwardly from two opposite ends of the body portion 11, a vertical reinforcement wall 14 connected between the side walls 12, and a pair of retaining blocks 15 protruding sidewardly from bottom portions of the side walls 12 respectively. The housing 1 defines a receiving space 13 disposed among the side walls 12, the body portion 11 and the reinforcement wall 14. The receiving space 13 extends to exterior along the upper-to-lower direction. The reinforcement wall 14 is spaced downwardly from the body portion 11. The retaining blocks 15 each is adapted for being mounted on the mother board, and defines a pair of through retaining holes 151 spaced from each other along a front-to-rear direction.

The body portion 11 includes an upper wall 111, a lower wall 112 opposed to the upper wall 111, and an elongated central slot 113 formed therebetween. The upper wall 111 and the lower wall 112 each defines a plurality of passageways 114, 115 in communication with the central slot 113 and receiving space 13. The central slot 113 is divided into two different lengths by a key portion 118. The key portion 118 defines a pair of retention slots 119 recessed forwardly thereinto from the receiving space 13. The retention slots 119 are spaced from each other along an upper-to-lower direction. The side walls 12 each defines an inner rib 122 extending from the reinforcement wall 14 to a rear surface thereof. Each of the side walls 12 defines a horizontal depression 124 formed in an upper edge thereof and a vertical depression 125 formed in a rear edge thereof and connected to the horizontal depression 124. The horizontal depressions 124 and the vertical depressions 125 are in communication with the receiving space 13 respectively. two opposite side portions of the body portion 11 each defines a pair of grooves 116 in communication with the receiving space 13 and adjacent to inner surfaces of the side walls 12 respectively. Each pair of grooves 116 are spaced from each other along the upper-to-lower direction.

The contacts 2 each includes a retention portion 21 retained in the passageways 114, 115, a resilient contact portion 22 protruding into the central slot 113 from the retention portion 21 for mating with the memory card, and a solder tail 23 bending downwardly out of the housing 1 from the retention portion 21.

The cover 3 is made of insulative material, and includes a top wall 31, and a rear wall 32 extending downwardly and perpendicularly from the top wall 31. The top wall 31 and the rear wall 32 are sandwiched between the pair of side walls 12 of the housing 1 and wholly retained in the receiving space 13 of the housing 1. The top wall 31 and the rear wall 32 each has two opposite side edges 310, 320 retained in the horizontal depressions 124 and the vertical depressions 125 respectively for being prevented from moving downwardly and forwardly. The top wall 31 has a top surface disposed in a same horizontal plane as a top surface of the housing 1. The rear wall 32 also has a rear surface disposed in a same vertical plane as the rear surfaces of the side walls 12 of the housing 1.

The side edges 320 of the rear wall 32 each has an upper notch 321 adjacent to the top wall 31, a lower notch 322 spaced downwardly from the upper notch 321, a pair of extensive arms 323, 324 extending forwardly from inner walls of the notches 321, 322 respectively, and a cutout 327 disposed at a bottom corner and under the lower notch 322. The extensive arms 323, 324 are perpendicular to the rear wall 32. The extensive arms 323, 324 have distal ends retained in the grooves 116 of the housing 1 respectively. The ribs 122 of the side walls 12 are located in the cutouts 327 respectively for preventing the cover 3 from moving downwardly. The rear wall 32 defines a retention arm 325 protruding forwardly therefrom and corresponding to the key portion 118 of the housing 1. The retention arm 325 defines a pair of fingers 326 retained into the retention slots 119 forwardly, respectively.

The spacer 4 is retained upwardly in the receiving space 13. The spacer 4 has a base 41 with a plurality of through holes 410 corresponding to the solder tails 23, and a protrusion 42 protruding sidewardly from the base 41. The ribs 122 abut against the protrusions 42 respectively for preventing the spacer 4 from moving upwardly respect to the housing 1. The rear wall 32 of the cover 3 abuts forwardly against a rear end of the spacer 4 for urging the spacer 4 to be sandwiched between the cover 3 and the housing 1 along the front-to-rear direction. The rear end of the spacer 4 is enclosed by the rear wall 32. The spacer 4 has a bottom surface disposed above a bottom surface of the rear wall 32.

Figure 5:
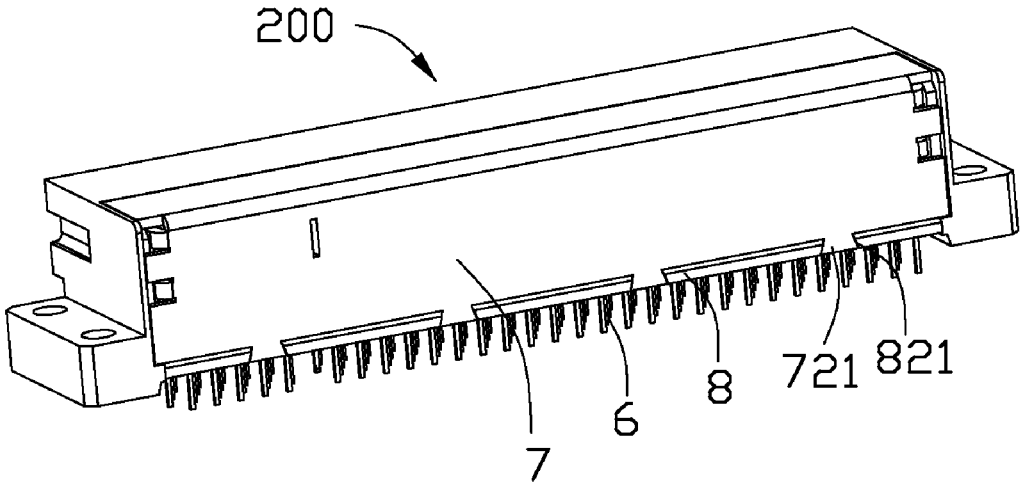
FIG. 5 is a perspective view of a card edge connector in accordance with a second embodiment of the present invention.
Figure 6:
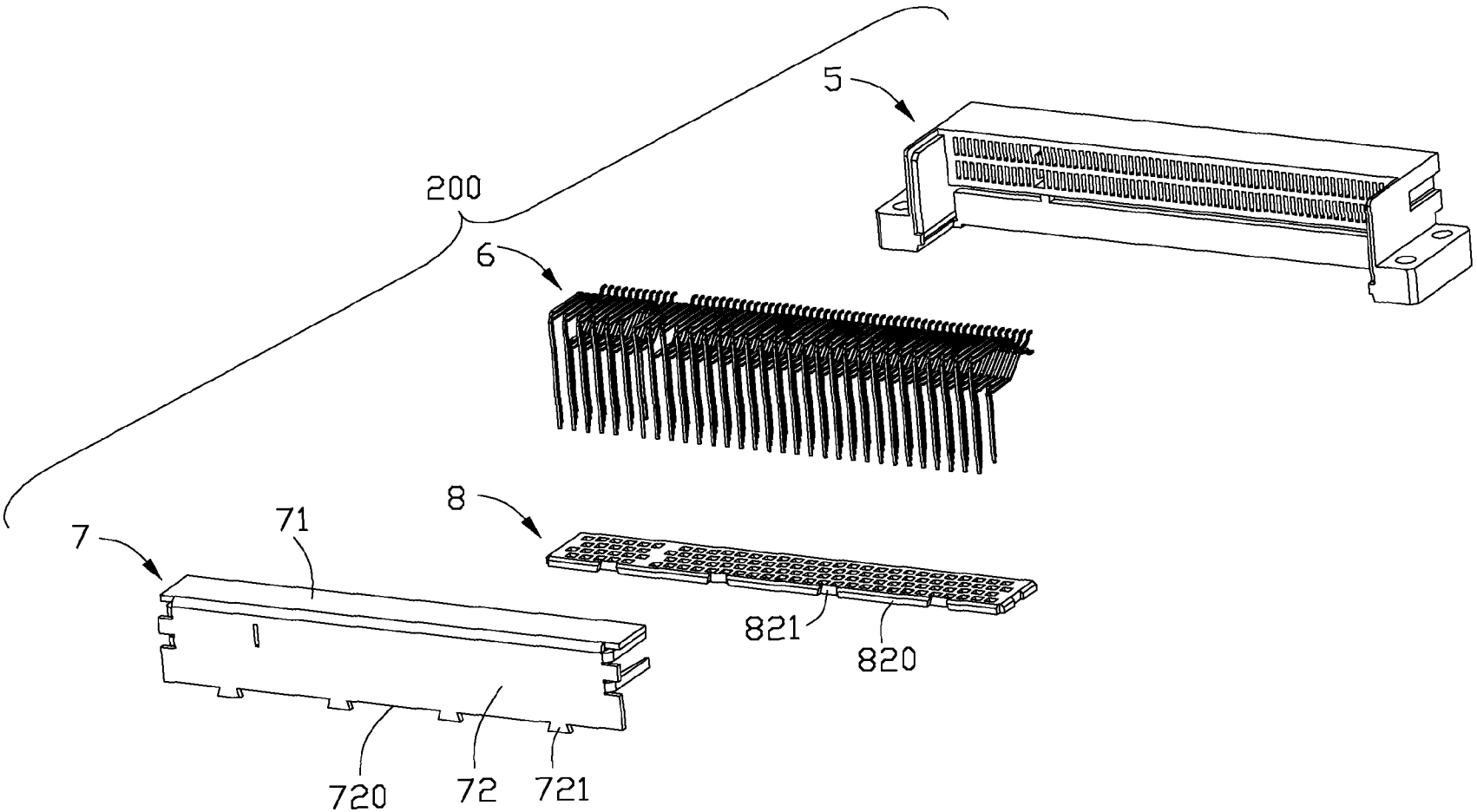
FIG. 6 is an exploded view of the card edge connector shown in the FIG. 5.

With reference to FIGS. 5-6, a card edge connector 200 in accordance with a second embodiment of the present invention. The card edge connector 200 comprises an elongated housing 5, a plurality of conductive contacts 6 retained in the housing 5, an insulative cover 7 and a spacer 8 both retained in the housing 5.

The cover 7 includes a top wall 71, and a rear wall 72 extending downwardly from the top wall 71. The rear wall 72 has a bottom edge 720 with a plurality of dovetail blocks 721 extending downwardly and arranged along a left-to-right direction. The spacer 8 has a rear edge 820 with a plurality of dovetail slots 821 passing downwardly therethrough and corresponding to the dovetail blocks 721 of the cover 7. The dovetail blocks 721 are retained in the dovetail slots 821 for preventing the spacer 8 from moving along an upper-to-lower direction. The dovetail blocks 721 further abut forwardly against the spacer 8 for ensuring the spacer 8 to be sandwiched between the cover 7 and the housing 5 reliably along the front-to-rear direction.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an insulative housing defining a front mating face and a central slot recessed rearwardly from the mating face;

a plurality of contacts retained in the insulative housing and each having a contact portion exposed into the central slot for mating with a complementary connector and a solder tail exposed to outside of the housing;

a cover assembled to a rear side of the housing, and a spacer sandwiched between the housing and the cover along a front-to-rear direction, the spacer defining a plurality of through holes through which the solder tails of the contacts pass; wherein the cover includes a top wall, and a rear wall extending downwardly and perpendicularly from the top wall, the rear wall abuts forwardly against a rear end of the spacer, and the spacer has a bottom surface disposed not lower than a bottom surface of the rear wall along an upper-to-lower direction.

2. The card edge connector as claimed in claim 1, wherein the cover is made of insulative material, both of the cover and the spacer are wholly retained in the housing, the cover has a top surface disposed in a same horizontal plane as a top surface of the housing, the cover has a rear surface disposed in a same vertical plane as a rear surfaces of the housing.

3. The card edge connector as claimed in claim 1, wherein the housing includes a body portion, a pair of side walls protruding rearwardly and downwardly from two opposite side ends of the body portion, and a receiving space formed thereamong, the receiving space extends to exterior along the upper-to-lower direction, the cover and the spacer are sandwiched between the pair of side walls respectively.

4. The card edge connector as claimed in claim 3, wherein the side walls each defines a horizontal depression formed in an upper edge thereof and a vertical depression formed in a rear edge thereof and connected to the horizontal depression, the horizontal depression and the vertical depression are in communication with the receiving space, the top wall and the rear wall each defines two opposite side edges retained in the horizontal depression and the vertical depression respectively for being prevented from moving forwardly and downwardly respect to the housing.

5. The card edge connector as claimed in claim 3, wherein the central slot is divided into two different lengths by a key portion, the key portion defines a pair of retention slots recessed forwardly thereinto from the receiving space, the retention slots are spaced from each other along the upper-to-lower direction, the rear wall defines a retention arm protruding in the receiving spacer therefrom, the retention arm defines a pair of fingers retained into the retention slots forwardly, respectively.

6. The card edge connector as claimed in claim 3, wherein the side walls each defines an inner rib extending along the front-to-rear direction, the ribs are disposed in the receiving space, the ribs are located above the spacer and abut against the spacer for prevent the spacer from moving upwardly respect to the housing.

7. The card edge connector as claimed in claim 6, wherein the rear wall of the spacer defines a cutout disposed at a bottom corner, a rear end of the rib is retained in the cutout for preventing the rear wall from moving downwardly respect to the housing.

8. The card edge connector as claimed in claim 3, wherein Each side end of the body portion defines a pair of grooves in communication with the receiving space and adjacent to an inner surface of the side wall respectively, the rear wall has two opposite side edges each defining an upper notch adjacent to the top wall, a lower notch spaced downwardly from the upper notch, and a pair of extensive arms extending forwardly from inner walls of the notches respectively, the extensive arms are retained in the grooves respectively.

9. The card edge connector as claimed in claim 3, wherein the housing includes two opposited retaining blocks protruding sidewardly from bottom portions of the side walls, and a vertical reinforcement wall connected between the side walls, the retaining blocks are adapted for being mounted on a mother board, and each defines a retaining hole passing therethrough along the upper-to-lower direction, the reinforcement wall is spaced downwardly from the body portion.

10. The card edge connector as claimed in claim 3, wherein the rear wall of the cover has a bottom edge with a plurality of dovetail blocks extending downwardly and arranged along a left-to-right direction, the spacer has a rear edge with a plurality of dovetail slots passing downwardly therethrough, the dovetail blocks are retained in the dovetail slots for preventing the spacer from moving along an upper-to-lower direction, the spacer is sandwiched between the dovetail blocks and the housing along the front-to-rear direction.

11. A card edge connector, comprising:

an insulative housing including a body portion with an elongated central slot, two opposite side walls protruding rearwardly and downwardly from the body portion, and a receiving space formed thereamong;

a plurality of contacts disposed in the housing with contact portions exposed into the central slot for mating with a complementary connector, solder tails exposed to outside of the body portion;

an insulative cover wholly retained in the receiving space, and having a top wall and a rear wall bending downwardly from the top wall, both of the top wall and the rear wall enclosing the receiving space; and an insulative spacer located in the receiving space and defining a plurality of through holes through which said solder tails extend;

wherein at least one of the cover and the spacer is fastened to the housing, each of the side walls of the housing defines a horizontal depression formed in an upper edge thereof and a vertical depression formed in a rear edge thereof and connected to the horizontal depression, the horizontal depression and the vertical depression are in communication with the receiving space respectively, the top wall and the rear wall each has two opposite side edges retained in the horizontal depressions and the vertical depressions respectively for being prevented from moving downwardly and forwardly, the spacer is sandwiched between a bottom edge of the rear wall and the body portion of the housing along a front-to-rear direction.

12. The card edge connector as claimed in claim 11, wherein the central slot is divided into two different lengths by a key portion, the key portion defines a retention slot recessed forwardly thereinto from the receiving space, the rear wall defines a retention arm protruding forwardly into the receiving spacer therefrom.

13. The card edge connector as claimed in claim 11, wherein a side portion of the body portion defines a groove in communication with the receiving space and adjacent to an inner surface of the side wall, the side edge of the rear wall has a notch and an extensive arm extending forwardly from an inner wall of the notch, the extensive arm abuts against the side wall, and has a distal end retained in the groove.

14. The card edge connector as claimed in claim 11, wherein the rear wall of the cover has a bottom edge with a plurality of dovetail blocks extending downwardly and arranged along a left-to-right direction, the spacer has a rear edge with a plurality of dovetail slots passing downwardly therethrough, the dovetail blocks are retained in the dovetail slots for preventing the spacer from moving along an upper-to-lower direction, the spacer is sandwiched between the dovetail blocks and the housing along the front-to-rear direction.

15. The card edge connector as claimed in claim 11, wherein the rear wall defines a bottom surface coplanar with a bottom surface of the spacer but higher than a bottom surface of the insulative housing.

16. An electrical connector comprising:

an insulative housing defining an elongated mating slot along a lengthwise direction;

a plurality of terminals inserted into the housing with contacting sections exposed in the mating slot and mounting sections extending vertically on a rear side of the housing;

a spacer upwardly assembled to the housing on said rear side and equipped with a plurality of through holes to allow said mounting sections to downwardly extend; and a rear cover forwardly assembled to the housing on said rear side and equipped with means for fastening to at least the housing; wherein the whole spacer is essentially hidden by the rear cover in a vertical direction perpendicular to said lengthwise direction; wherein said spacer and said rear cover are fastened to each other via a dovetail structure for no relative movement therebetween in the vertical direction.

17. The electrical connector as claimed in claim 16, wherein said spacer is further hidden by the rear cover in a front-to-back direction perpendicular to both said vertical direction and said lengthwise direction.

18. The electrical connector as claimed in claim 16, wherein said spacer is hidden by corresponding end walls of the housing in said lengthwise direction.

* * * * *